United States Patent [19]

Camic

[11] 4,138,627

[45] Feb. 6, 1979

[54] CURRENT-LEVEL-SENSITIVE SWITCHING SYSTEM

[75] Inventor: Donald L. Camic, Granada Hills, Calif.

[73] Assignee: Hughey and Phillips, Inc., Burbank, Calif.

[21] Appl. No.: 859,805

[22] Filed: Dec. 12, 1977

Related U.S. Application Data

[63] Continuation of Ser. No. 609,286, Sep. 2, 1975, abandoned.

[51] Int. Cl.[2] ..... H05B 37/02

[52] U.S. Cl. ..... 315/313; 307/39; 315/131; 315/201; 315/250; 315/254; 340/26; 340/664

[58] Field of Search ..... 315/312–315, 315/131, 132, 201, 250, 254; 340/26, 310 A, 538, 664; 307/39, 64; 318/317

[56] References Cited

U.S. PATENT DOCUMENTS

| | | | |
|---|---|---|---|
| 2,754,464 | 7/1956 | Wizenez et al. | 318/434 |
| 3,061,828 | 10/1962 | Hauck | 340/251 |
| 3,513,353 | 5/1970 | Lansch | 328/150 |
| 3,523,238 | 8/1970 | Jones | 340/251 |
| 3,683,284 | 8/1972 | Mueller | 328/117 |
| 3,768,545 | 10/1973 | Wills | 307/39 |
| 3,829,735 | 8/1974 | Berlock et al. | 315/131 |
| 3,835,333 | 9/1974 | Balan | 307/64 |

OTHER PUBLICATIONS

*Voltage Comparator Circuit,* IBM Technical Disclosure Bulletin, vol. 17, No. 4, Sep. 1974, p. 1151.

*Primary Examiner*—Eugene P. LaRoche
*Attorney, Agent, or Firm*—Bruce L. Birchard

[57] ABSTRACT

A solid-state switching system which produces one or more switching signals in response to a power circuit current's reaching a preset level or levels whereby remote control of associated apparatus may be effected without independent control circuits.

5 Claims, 2 Drawing Figures

CURRENT-LEVEL-SENSITIVE SWITCHING SYSTEM

This is a continuation of application Ser. No. 609,286, filed 9/2/75, now abandoned.

BACKGROUND OF THE INVENTION

1. Field of the Invention

This invention relates to remote switching systems utilizing, to achieve the desired switching function, conductive circuits having other primary functions.

2. Description of the Prior Art

Many electrical circuits, such as lighting circuits, utilize the power-carrying conductors to carry control information as well. In these applications it is common to use carrier currents, i.e., currents above the frequency of the power current, to effect switching of the lights or other equipment. Such carrier current systems have the disadvantage of signal loss over long distances, particularly when transformers or other such impedances are interposed.

In other applications, such as in airport lighting, separate and independent control wires are run to remote sites from a control center to effect the switching on or off of lights or other apparatus. Obviously, such independent circuits are expensive to install and may increase maintenance costs because they constitute additional elements in a system and increase the probability of system breakdown.

Mechanical relays activated by line current or a current related to line current have the disadvantage of contact and other mechanical-part wear and produce line voltage drop.

Therefore, it is a general object of this invention to provide a remote switching system which is free of the problems and disadvantages hereinbefore set forth.

It is a more specific object of this invention to provide a remote switching system which utilizes the power conductors as the control conductors.

It is a still further object of this invention to provide a current-level-sensing switching system which is primarily solid state in its nature to assure high reliability.

SUMMARY OF THE INVENTION

A current transformer or Hall effect device is coupled to the conductor or conductors carrying current to a load, or to the magnetic field around a conductor carrying current to a load. The output potential derived from the current transformer circuit or from the Hall effect device is proportional to the current level in that conductor.

This potential is fed to a comparator IC chip such as the Radio Corporation of America IC designated CA 3099 through appropriate voltage dividing or switching-level adjusting potentiometers, including a "hysteresis" adjusting variable resistor. The output from the comparator switches from a "0" to a "1," or vice versa, when the line current or magnetic flux related to line current rises to a predetermined level and returns to its original state when the current level falls to a lower threshold set by the "hysteresis" potentiometer. When the comparator output switches from "0" to "1" or vice versa a power switch, such as an SCR or a relay, may be activated or de-activated to control associated apparatus.

BRIEF DESCRIPTION OF THE DRAWINGS

A better understanding of the present invention may be had from a consideration of the following detailed description, taken in conjunction with the accompanying drawings, in which:

FIG. 1 is a schematic diagram of a dual-level current-level-sensitive switching system according to the present invention.

DESCRIPTION OF THE PREFERRED EMBODIMENT

Figure 2:
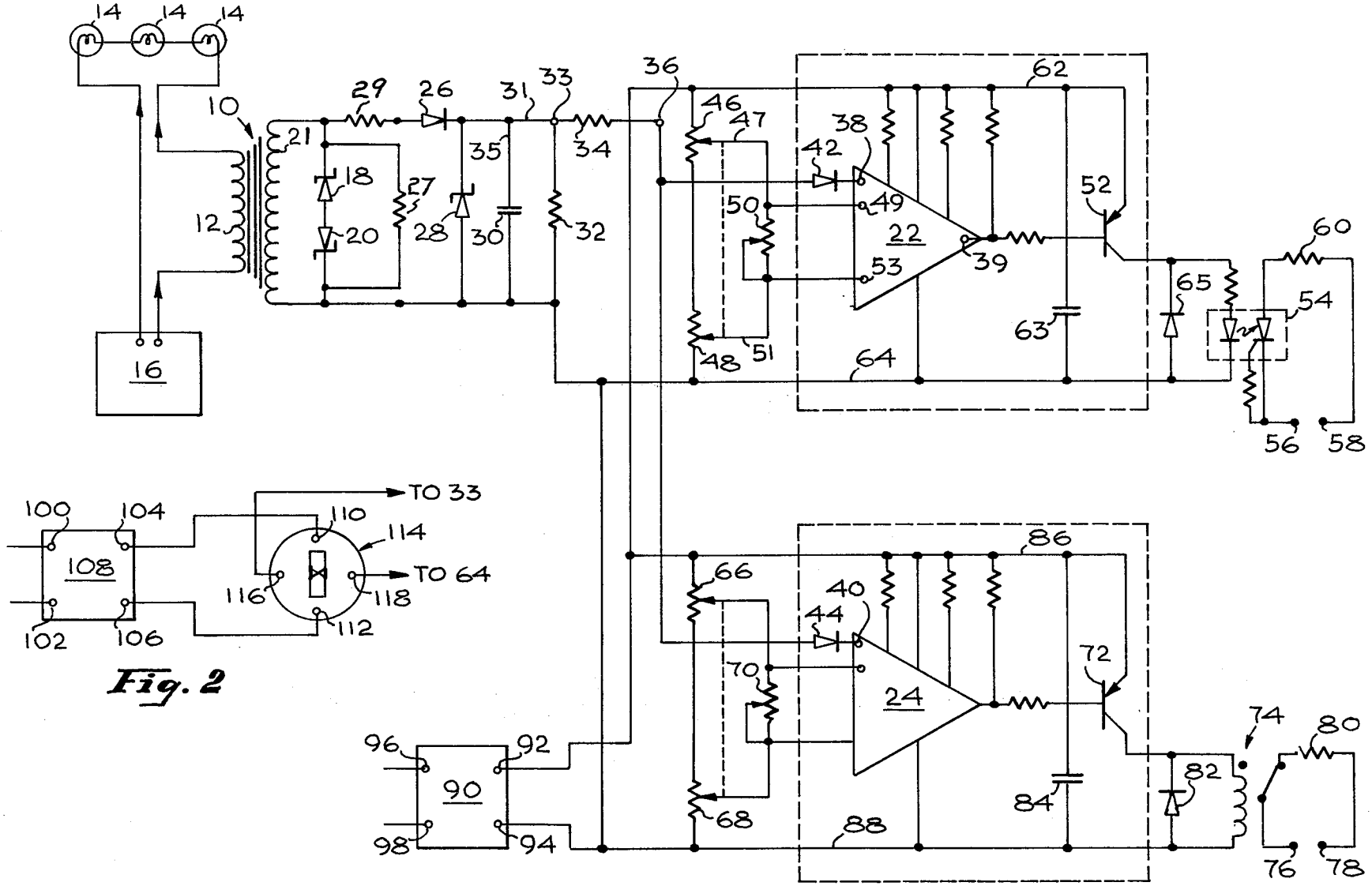
FIG. 2 is a schematic diagram of an alternate sensor for use in the system of FIG. 1.

In FIG. 1, transformer 10 is a current transformer and has its primary 12 connected in series with one conductor providing current to a load, for example runway lighting 14 in an airport lighting system, from an adjustable constant current source 16. Back-to-back zener diodes 18 and 20 shunt secondary 21 of transformer 10 to prevent excessive-voltages, in the form of transients, or the like, from destroying IC comparators 22 and 24. Resistor 27 acts as a constant load for secondary 21. Resistor 29 is a current limiting resistor. The AC voltage appearing across secondary 21 is rectified by diode 26, limited by zener diode 28 and filtered by condenser 30. Resistor 32 provides a constant load for zener diode 28. The voltage appearing across zener diode 28 is applied to input terminal 33 of current limiting resistor 34, the output terminal 36 of which is connected to signal input terminals 38 and 40 of IC comparators 22 and 24, respectively, through isolating diodes 42 and 44, respectively. Diodes 42 and 44 isolate the input terminals 38 and 40 from each other, for d.c. purposes.

IC comparators 22 and 24 are commercially available from such companies as Radio Corporation of America and bear the designation CA 3099. The details of their terminal connections and operating characteristics can be obtained from the Radio Corporation of America catalogues and specification sheets for such products, but, in essence, they compare an unknown potential with a reference potential and produce a change in state at the output terminal (such as terminal 39) when the unknown and reference voltages are substantially equal.

While FIG. 1 shows two comparator circuits, each set for actuation at a different level of current to lamps 14, it should be understood that only one comparator circuit may be used or more than two may be used, depending on the number of independent switching functions which are desired. In any case, there is a d.c. isolating diode at the control signal input terminal of each IC comparator.

Potentiometers 46 and 48 set the level at the which the output of comparator 22 changes state, that is from a "0" to a "1," or vice versa, when the current flowing through primary 12 is increased. Arm 47 of potentiometer 46 is connected to high reference terminal 49 of comparator 22. Arm 51 of potentiometer 48 is connected to low reference terminal 53 of comparator 22. Variable resistor 50 sets the "hysteresis" of comparator 22, that is, the level to which the current through primary 12 must fall to cause the output of comparator 22 to change back to its original state. Such switching level may be from 10 millivolts to the full voltage from power supply 90, those voltages corresponding to current "hysteresis" differentials of from 10% to 100% of the primary 12 current level at which the initial change of state of comparator 22 occurs. Transistor 52 is the driver transistor for the output switching citcuit including opto-isolator 54, power terminals 56 and 58 and load 60 (which may be the strobe lights in an airport lighting system). Appropriate operating potentials for IC comparator 22 are applied through buses 62 and 64 between which filter condenser 63 is connected. Diode 65 suppresses transients.

While an opto-isolator has been shown as the means for switching on and off the potential applied to load 60 it should be understood that other solid state devices, such as an SCR or a triac may be used. An electromechanical switch, such as a relay, may also be used, as is shown in the circuit connected to comparator 24.

In that circuit, potentiometers 66 and 68 act as voltage dividers which set the level of current, in the increasing sense, through primary 12 at which the output from comparator 24 switches states. Variable resistor 70 sets the hysteresis, or level of falling current at which comparator 24 returns to its original state. Transistor 72 drives the switching device, in this case relay 74. Power flow from terminals 76 and 78 to load 80 (which may be airport approach lights, for example) is switched on and off by relay 74. Diode 82 prevents transient voltages from destroying the solid state devices which precede it in the circuit. Condenser 84 is a filter condenser across power buses 86 and 88 from which comparator 24 and transistor 72 operate.

Operating power from the solid state devices which have been described is derived from power supply 90 which provides, at its terminals 92 and 94, d.c. voltage appropriate for the operation of the circuit which has been described. AC line voltage is applied to input terminals 96 and 98 of power supply 90.

In an actual installation, potentiometers 46 and 48 were adjusted so that when the current flowing to runway lamps 14 reached 2.5 amperes, the current to load 60, which comprised airport approach lights, was switched on. When the current flowing to lamps 14 was reduced to 2.3 amperes (i.e., a "hysteresis" of 0.2 amperes) the approach lamps were switched off.

When the current flowing to lamps 14 reached 4.8 amperes, relay 74 closed and passed current to load 80, which comprised strobe lamps in the airport lighting system. When the current was reduced to 4.6 amperes, the strobe lamps were turned off (again a "hysteresis" of 0.2 amperes).

Instead of using current level directly as a switching reference it may be desirable to measure the magnetic flux arising from such flow. An alternate sensor, responsive to magnetic flux, is shown in FIG. 2. AC line voltage applied to terminals 100 and 102 is rectified and supplied at a constant current level to terminals 104 and 106 of power supply 108. Circuits for rectifying AC and supplying constant current DC are well known and need not be described here. Constant current DC is supplied from terminals 104 and 106 of supply 108 to activating terminals 110 and 112 of Hall device 114. Control terminal 116 of Hall device 114 is connected to terminal 33 of resistor 34 in FIG. 1. Remaining terminal 118 of Hall device 114 is connected to bus 64. With Hall device 114 so connected in the circuit, conductors 31 and 35 are broken and Hall device 114 replaces current transformer 10 as the controlling sensor. The magnetic-flux-sensing capability of a Hall device is well known and need not be described here.

While a particular embodiment of a current-level-sensitive switching system according to the present invention has been shown and described it should be apparent to those skilled in the art that variations thereof may be made without departing from this invention and it is intended that all such variations shall be included within the scope of the appended claims.

What is claimed is:

1. An airport lighting system having first and second sets of electric lamps, said first set of lamps being operated only in low ambient light levels, said second set of lamps being operated at a first finite current level in normal daylight and at a second finite current level at low ambient light levels;

sensing means coupled to said second set of lamps for sensing said first and second current levels respectively; and, switching means coupled to said sensing means and to said first set of lamps for switching said first set of lamps "off" when said current to said second set of lamps is at said first finite level and switching said first set of lamps "on" when said current to said second set of lamps is at said second finite level.

2. Apparatus according to claim 1 in which said sensing means includes a voltage comparator.

3. Apparatus according to claim 2 in which said comparator includes a signal terminal, a high reference terminal, a low reference terminal and an output terminal and is responsive to predetermined finite signal levels at said signal terminal to produce changes of signals from said output terminal sequentially between first and second states and said switching means is coupled to said output terminal and is responsive to the changes in state at said output terminal.

4. Apparatus according to claim 3 which includes, in addition, level setting means coupled to said high and low reference terminals for predetermining the finite signal levels at said signal terminal which will produce said changes between states of said signals from said output terminal.

5. Apparatus according to claim 1 in which said sensing means includes a current transformer.

* * * * *